US005706677A

United States Patent [19]

Matsuda

[11] Patent Number: 5,706,677

[45] Date of Patent: Jan. 13, 1998

[54] WARP-KNIT TAPE FOR SLIDE FASTENER

[75] Inventor: Yoshio Matsuda, Toyama-ken, Japan

[73] Assignee: YKK Corporation, Tokyo, Japan

[21] Appl. No.: 666,839

[22] Filed: Jun. 19, 1996

[30] Foreign Application Priority Data

Jun. 22, 1995 [JP] Japan ..... 7-155780

[51] Int. Cl.[6] ..... A44B 19/34

[52] U.S. Cl. ..... 66/192; 66/193; 66/195; 24/393

[58] Field of Search ..... 66/193, 194, 195, 66/196

[56] References Cited

U.S. PATENT DOCUMENTS

| | | | |
|---|---|---|---|
| 3,840,946 | 10/1974 | Fröhlich . | |
| 4,044,575 | 8/1977 | Krug | 66/195 X |
| 4,228,566 | 10/1980 | Matsuda | 66/195 X |
| 4,392,363 | 7/1983 | Matsuda | 66/193 |
| 4,502,302 | 3/1985 | Matsuda | 66/193 |
| 4,658,604 | 4/1987 | Wilson | 66/195 X |
| 5,257,515 | 11/1993 | Ikeguchi . | |

FOREIGN PATENT DOCUMENTS 2046 137 3/1972 Germany .

*Primary Examiner*—John J. Calvert

*Attorney, Agent, or Firm*—Hill, Steadman & Simpson

[57] ABSTRACT

A warp-knit tape has through its entire width tricot-stitch yarns formed of multifilament yarns and single-cord-stitch knitting yarns formed of textured yarns. A fastener-element-attaching portion of the warp-knit tape includes chain-stitch knitting yarns formed of multifilament yarns and warp in-laid yarns formed of multifilament yarns, with an outer one of the chain-stitch knitting yarns being thick. An outer one of the tricot-stitch knitting yarns and an outer one of the single-cord-stitch yarns in the web portion are thick to reinforce the edge. Thus, the resulting fastener-element-attaching portion is non-stretchable, while the resulting web portion is stretchable.

22 Claims, 7 Drawing Sheets

WARP-KNIT TAPE FOR SLIDE FASTENER

BACKGROUND OF THE INVENTION

1. Field of the Invention

This invention relates to a tape to be used in a slide fastener, and more particularly to a warp-knit tape for a slide fastener, which has a fastener-element-attaching portion restricted in longitudinal stretch and a web portion longitudinally stretchable.

2. Description of the Related Art

U.S. Pat. No. 4,041,577, the U.S. Pat. No. 5,257,515 and U.S. Pat. No. 4,228,566 disclose a small-width warp-knit slide fastener tape of the type having a plurality of parallel longitudinal wales. According to tile first and second-named publications, chain-stitch knitting yarns extend one in and along every wale and are interlaced with other yarns, e.g. tricot-stitch knitting yarns, two-needle-stitch knitting yarns or weft in-laid yarns, so that the tape is restricted in warpwise or longitudinal stretch. According to the last-named publication, the warp-knit structure of opposite side edges are knitted of chain-stitch knitting yarns, tricot-stitch knitting yarns and single-cord-stitch knitting yarns so as to be interlaced with one another, so that the tape is restricted in stretch.

Further, Japanese Patent Laid-Open Publication No. Hei 4-352901 discloses a small-width warp-knit tape in which a warp-knit structure of opposite side edges is knitted of double-tricot-stitch knitting yarns and weft in-laid yarns so as to be interlaced with one another, or of tricot-stitch knitting yarns, single-cord-stitch knitting yarns and weft in-laid yarns so as to be interlaced with one another, so that the tape is longitudinally stretchable.

Still further, U.S. Pat. No. 4,502,302 discloses a small-width warp-knit slide fastener tape in which the knit structure of side edges is knitted of tricot-stitch knitting yarns and weft in-laid yarns so as to be interlaced with one another, so that the tape is longitudinally stretchable. And the tricot-stitch knitting yarns or weft in-laid yarns are thicker than the other knitting yarns of the same kind to increase the tape edges in thickness and hence to reinforce the tape edges.

In the warp-knit tapes of the first three of the above-mentioned prior publications, the knit structure is restricted in longitudinal stretch through its entire width or only at side edges. In use, the resulting slide fastener is sewn to a garment. Even when the garment is bent or stretched, the warp-knit tape does not stretch at its portion attached to the garment so that this attaching portion would be stiff even if the sewing threads stretch, giving a touch of physical disorder.

In the warp-knit tape of the fourth-named publication, since the tape is longitudinally stretchable through its entire width, the fastener-element-attaching portion also is stretchable so that stable attaching of the fastener elements cannot be achieved, making the tape unsuitable for a slide fastener. Further, since no thick knitting yarn is not used in the side edges of the warp-knit tape, the tape is not reinforced enough and is hence deficient in durability. Furthermore, since weft in-laid yarns extend in and along every other courses, the tape edges are pulled inwardly to make the tape ugly in appearance.

Further, in the warp-knit slide fastener tape of the fifth-named publication, the side edges of the tape is knitted of tricot-stitch knitting yarns having a knitting pattern of 1-2/1-0 and a weft in-laid yarn laid in a pattern of 0-0/4-4, and the tricot-stitch knitting yarns or the weft in-laid yarn is thick to reinforce the tape edges. If the tricot-stitch knitting yarns are thick, the tape is reinforced only at every other courses so that the knitting yarns would be shifted to impair the tape. If the weft in-laid yarn is thick, loops preceding and succeeding the tricot-stitch knitting yarns are interlaced by a single weft in-laid yarn so that the tape would not be neat in appearance.

SUMMARY OF THE INVENTION

It is therefore an object of this invention to provide a warp-knit tape, for a slide fastener, which easily adapts itself to stretcing or curving actions of a garment, when the slide fastener is attached to a stretchable garment, and in which the tape edges of the warp-knit tape are uniformly and neatly reinforced so as to be hardly damaged even in long use, guaranteeing smooth movement of a slider.

In order to accomplish the above object, according to this invention, there is provided a warp-knit tape for a slide fastener, which has a plurality of parallel longitudinal wales, comprising: a web portion having a longitudinally stretchable first knit structure, an outer edge of the first knit structure being knitted of two kinds of thick knitting yarns interlooped with one another; and a fastener-element-attaching portion having a longitudinally non-stretchable second knit structure, an outer wale of the second knit structure being knitted of a thick knitting yarn.

Preferably, the wales of the fastener-element-attaching portion are knitted of chain-stitch knitting yarns and other knitting yarns interlooped with the chain-stitch knitting yarns, one of the chain-stitch knitting yarns which extends in and along the outer wale of the second knit structure, being thick. On the other hand, the wales of the web portion may be knitted of single-cord-stitch knitting yarns formed of textured yarns, and other knitting yarns formed of multifilament yarns interlaced with the single-cord-stitch knitting yarns, one of the knitting yarns, which extend in and along the outer edge of the first knit structure, being thick.

Further, the outer wale of the web portion is knitted of loops of the single-cord-stitch knitting yarns, each of which is thick, and loops of tricot-stitch knitting yarns, each of which is thick, being interlooped with those of the single-cord-stitch knitting yarns. Alternatively, the outer edge of the web portion may be knitted of a single-cord-stitch knitting yarn which is formed of a single thick knitting yarn, and tricot-stitch knitting yarns which are formed of two thick knitting yarns, being interlooped with the single-cord-stitch knitting yarn. In another alternative form, every wale in the fastener-element-attaching portion and the web portion includes a single-cord-stitch knitting yarn and a tricot-stitch knitting yarn, every wale in the fastener-element-attaching portion additionally including chain-stitch knitting yarns and warp in-laid yarns.

Furthermore, the outer edge of the first knit structure in the web portion is knitted of a single-cord-stitch knitting yarn which is formed of a single thick knitting yarn, and a two-needle-stitch knitting yarn which is formed of a single thick knitting yarn being interlooped with the single-cord-stitch knitting yarns. And every wale in the fastener-element-attaching portion and the web portion includes a two-needle-stitch knitting yarn, and every wale in the fastener-element-attaching portion additionally includes a chain-stitch knitting yarn and a weft in-laid yarn, and every wale in the web portion additionally includes a single-cord-stitch knitting yarn.

DETAILED DESCRIPTION OF THE PREFERRED EMBODIMENTS

Figure 1:
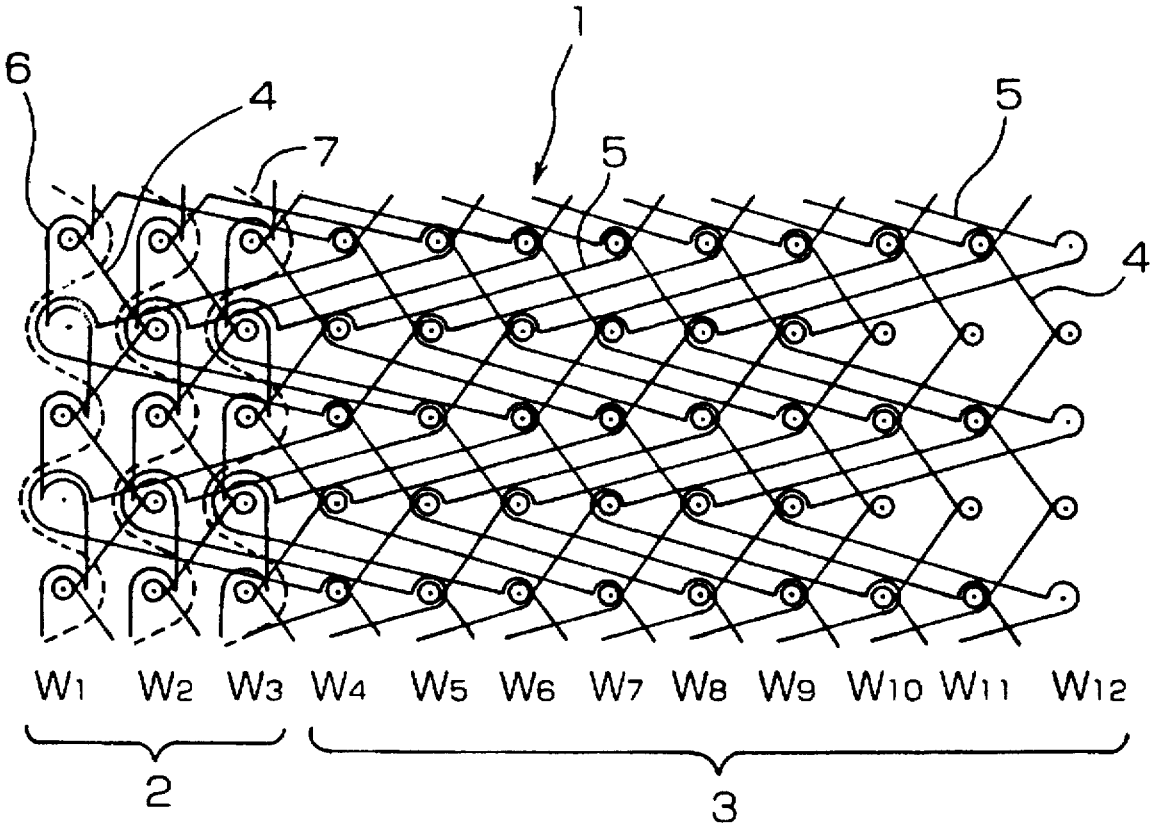
FIG. 1 is a diagram showing a knit structure of a warp-knit tape for a slide fastener, according to a first embodiment of this invention.
Figure 2:
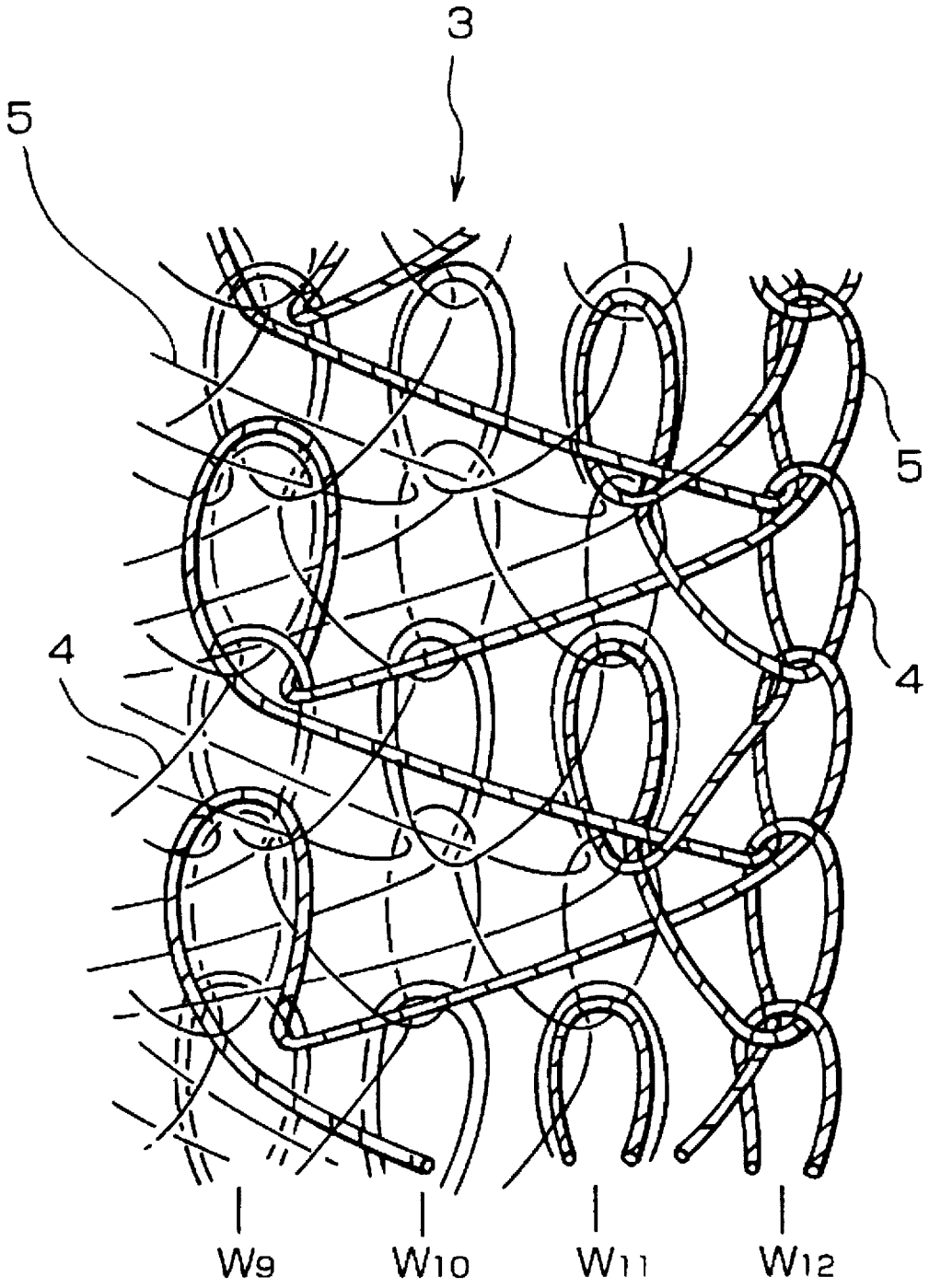
FIG. 2 is a fragmentary detailed view showing, on an enlarged scale, an edge of a web portion of the warp-knit slide fastener tape of the first embodiment.
Figure 3:
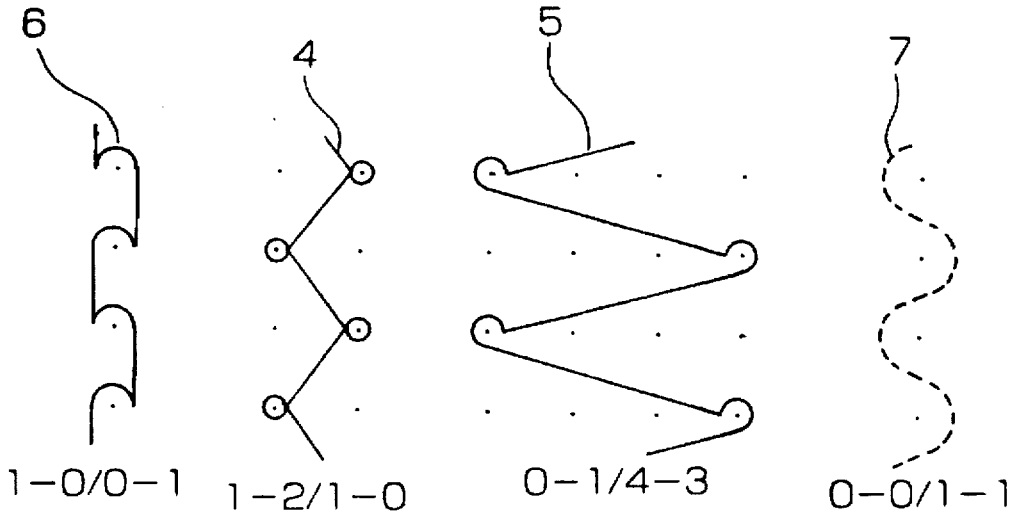
FIG. 3 is a diagram showing knitting patterns of individual knitting yarns of the above-mentioned warp-knit slide fastener tape of the first embodiment.

Preferred embodiments of a warp-knit tape, for a slide fastener, according to this invention will now be described in detail with reference to the accompanying drawings.

In the first and second embodiments shown in FIGS. 1 through 5, the warp-knit tape 1 is a small-width tape knitted in a warp-knit structure having through its entire width twelve longitudinal wales $W_1$–$W_{12}$. Three wales $W_1$–$W_3$ at one edge of the warp-knit tape 1 are formed in a stable knit structure restricting in warp-wise or longitudinal stretch, serving as a fastener-element-attaching portion 2 on which a row of fastener elements E is to be mounted. The remaining warp-knit tape portion is knitted in a knit structure stretchable in a longitudinal direction, serving as a web portion 3.

The warp-knit tape 1 comprises, through all the wales $W_1$–$W_{12}$, tricot-stitch knitting yarns 4 of 1-2/1-0, formed of multifilament yarns, and single-cord-stitch knitting yarns 5 of 0-1/4-3, formed of textured yarns and interlaced with the tricot-stitch knitting yarns 4. The outer wale $W_{12}$ of the web portion 3 is formed of loops of the tricot-stitch knitting yarns 4 and loops of the single-cord-stitch knitting yarns 5 interlooped with the loops of the tricot-stitch knitting yarns 4. The wales $W_1$–$W_3$ of the fastener-element-attaching portion 2 are knitted of chain-stitch knitting yarns 6 of 1-0/0-1, formed of multifilament yarns, and warp in-laid yarns 7 of 0-0/1-1, formed of multifilament yarns and interlaced with the chain-stitch knitting yarns 6. The fastener-element-attaching portion 2 and the web portion 3 jointly constitute the warp-knit tape 1.

In the fastener-element-attaching portion 2, the chain-stitch knitting yarn 6 of the wale $W_1$ is a thick knitting yarn of 100 d/2, each of the chain-stitch knitting yarns 6 of the wales $W_2$, $W_3$ is 100 d/1 in thickness, and each of the three warp in-laid yarns 7 to be laid in the wales $W_1$–$W_3$is a thick yarn of 100 d/3. Further, in the warp-knit tape 1 shown in FIGS. 1 and 2, each of the ten tricot-stitch knitting yarns 4 in the wales $W_1$–$W_{11}$ is a knitting yarn of 100 d/1, a single tricot-stitch knitting yarn 4 in the wales $W_{11}$, $W_{12}$ is a thick knitting yarn of 100 d/2, each of the eight single-cord-stitch knitting yarns 5 in the wales $W_1$–$W_{11}$is a knitting yarn of 100 d/1, and one single single-cord-stitch knitting yarn 5 in the wales $W_9$–$W_{12}$ is a thick knitting yarn of 100 d/2.

Figure 4:
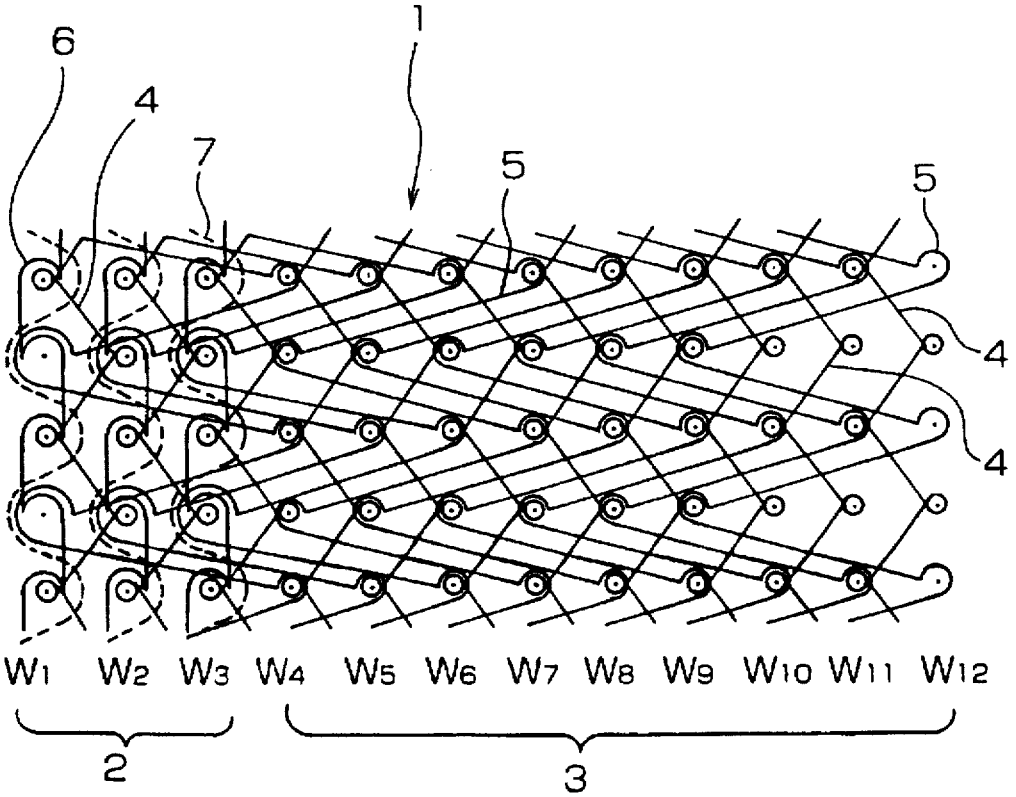
FIG. 4 is a diagram showing a knit structure of a warp-knit tape for a slide fastener, according to a second embodiment.
Figure 5:
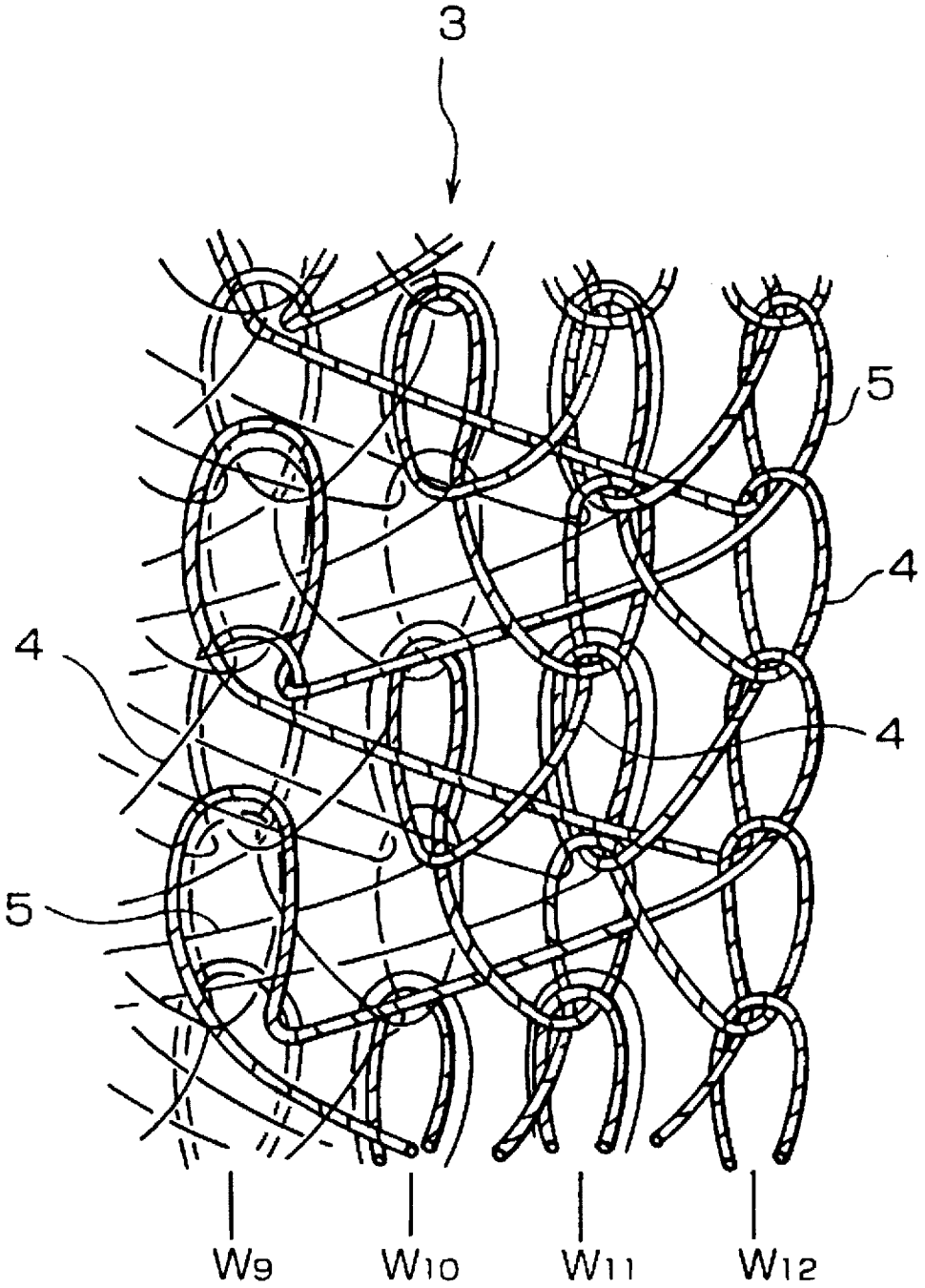
FIG. 5 is a fragmentary detailed view showing, on an enlarged scale, an edge of a web portion of the above-mentioned warp-knit slide fastener tape of the second embodiment.

In the warp-knit tape 1 shown in FIGS. 4 and 5, each of the nine tricot-stitch knitting yarns 4 in the wales $W_1$–$W_{10}$ is a knitting yarn of 100 d/1, each of the two tricot-stitch knitting yarns 4 in the wales $W_{10}$–$W_{12}$ is a thick knitting yarn of 100 d/2, each of the eight single-cord-stitch knitting yarns 5 in the wales $W_1$–$W_{11}$ is a knitting yarn of 100 d/1, and one single-cord-stitch knitting yarn 5 in the wales $W_9$–$W_{12}$ is a thick knitting yarn of 100 d/2.

In each of the foregoing embodiments, each single-cord-stitch knitting yarn may be a knitting yarn of 0-1/3-2 across three wales, and each knitted stitch of the knit structure may be either an open stitch or a closed stitch.

Figure 6:
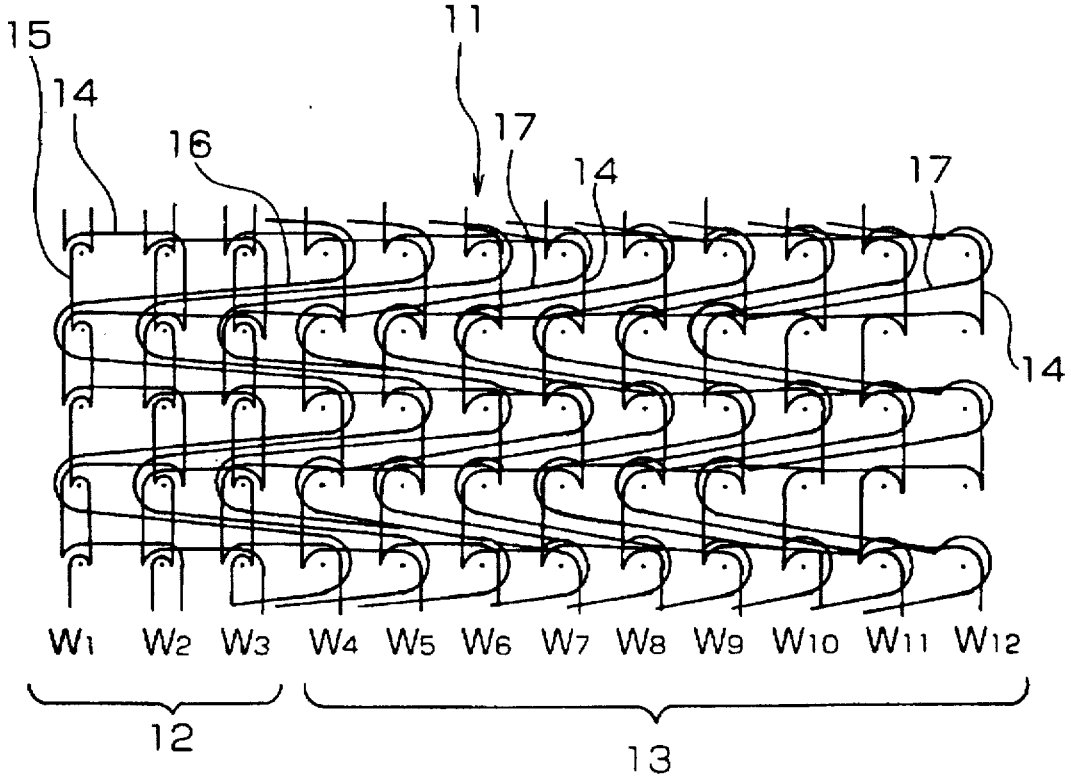
FIG. 6 is a diagram showing a knit structure of a warp-knit slide fastener tape for a slide fastener, according to a third embodiment.
Figure 7:
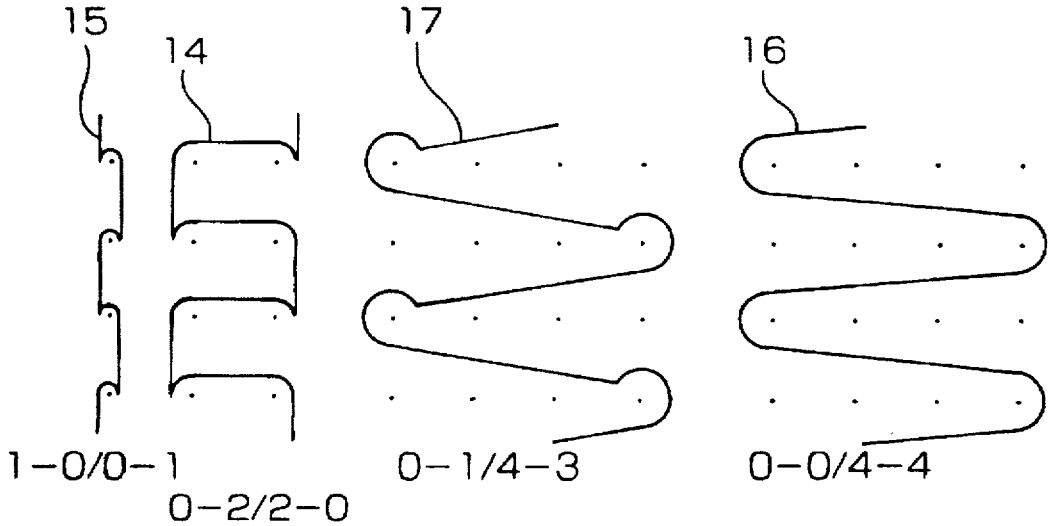
FIG. 7 is a diagram showing knitting patterns of individual knitting yarns of the warp-knit slide fastener tape of the third embodiment.
Figure 8:
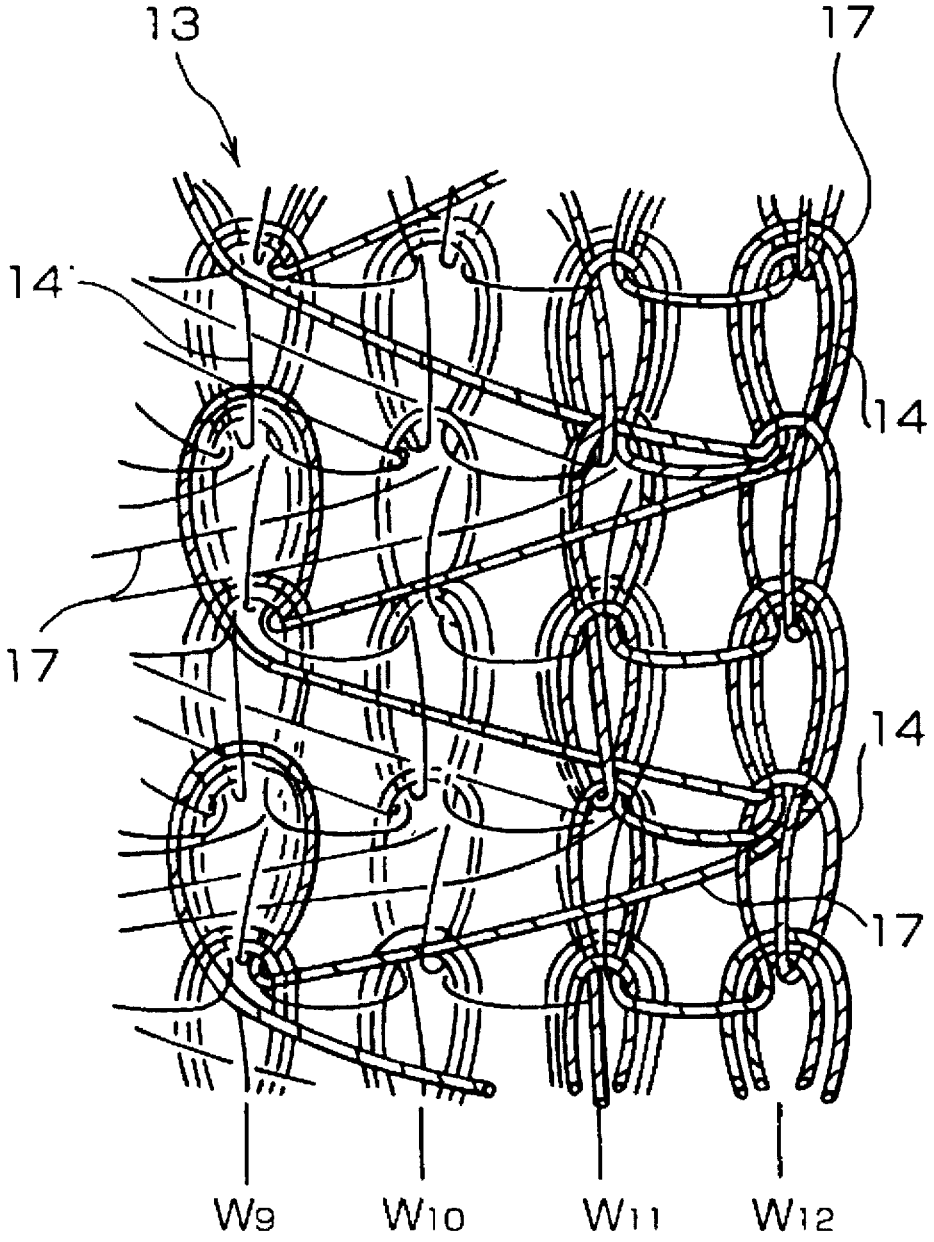
FIG. 8 is a fragmentary detailed view showing, on an enlarged scale, the edge of a web portion of the warp-knit slide fastener tape of the third embodiment.

In a embodiment shown in FIGS. 6 through 8, the warp-knit tape 11 is a small-width warp-knit tape having through its entire width longitudinal wales $W_1$–$W_{12}$. The warp-knit tape 11 has at one edge a fastener-element-attaching portion 12 knitted in a stable knit structure restricting in longitudinal stretch, and the remaining portion is knitted in a warp-knit structure longitudinally stretchable and serving as a web portion 13.

The warp-knit tape 11 includes, through all the wales $W_1$–$W_{12}$, two-needle-stitch knitting yarns 14 of 0-2/2-0 formed of multifilament yarns. The wales $W_1$–$W_3$ of the fastener-element-attaching portion 12 are knitted of chain-stitch knitting yarns 15 of 1-0/0-1, formed of multifilament yarns, and the wales $W_1$–$W_6$ include warp in-laid yarns 16 of 0-0/4-4, formed of textured yarns. The wales $W_4$–$W_{12}$ of the web portion 13 includes single-cord-stitch knitting yarns 17 of 0-1/4-3, formed of textured yarns. The fastener-element-attaching portion 12 and the web portion 13 jointly constitute the warp-knit tape 11.

In the fastener-element-attaching portion 12 of the warp-knit tape 11, the chain-stitch knitting yarn 15 in the wale $W_1$ is a thick knitting yarn of 100 d/2, each of the chain-stitch knitting yarns 15 of the wales $W_2$, $W_3$ is 100 d/1 in thickness. In the warp-knit tape 11, a weft in-laid yarns 16 in the wales $W_1$–$W_6$ is 100 d/1 in thickness, each of the ten two-needle-stitch knitting yarns 14 in the wales $W_1$–$W_{11}$ is a knitting yarn of 70 d/1, one two-needle-stitch knitting yarn in the wales $W_{11}$, $W_{12}$ is a thick knitting yarn of 70 d/2, each of the five single-cord-stitch knitting yarns 17 in the wales $W_4$–$W_{11}$ is a knitting yarn of 100 d/1, and one single-cord-stitch knitting yarn 17 in the wales $W_9$–$W_{12}$ is a thick knitting yarn of 100 d/2.

In this embodiment, the weft in-laid yarns may extend across three wales in a pattern of 0-0/3-3, and each single-cord-stitch knitting yarn may be a knitting yarn of 0-1/3-2 also extending across three wales, and like the previous embodiments, each knitted stitch of the knit structure may be either an open stitch or a closed stitch.

Figure 9:
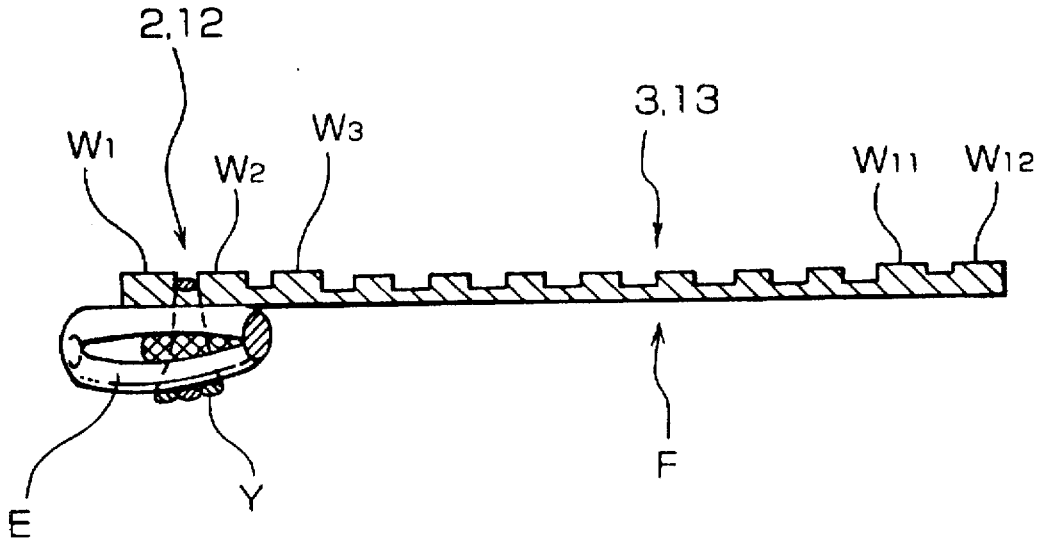
FIG. 9 is a transverse cross-sectional view showing a slide fastener stringer using the warp-knit tape of this invention.

In the warp-knit slide fastener tape of this invention, fastener elements E are to be attached, by a sewing thread Y, to the non-stretchable fastener-element-attaching portion 2, 12 in which chain-stitch knitting yarns 6, 15 are knitted in the outer wale of one side of the tape as shown in FIG. 9.

Figure 10:
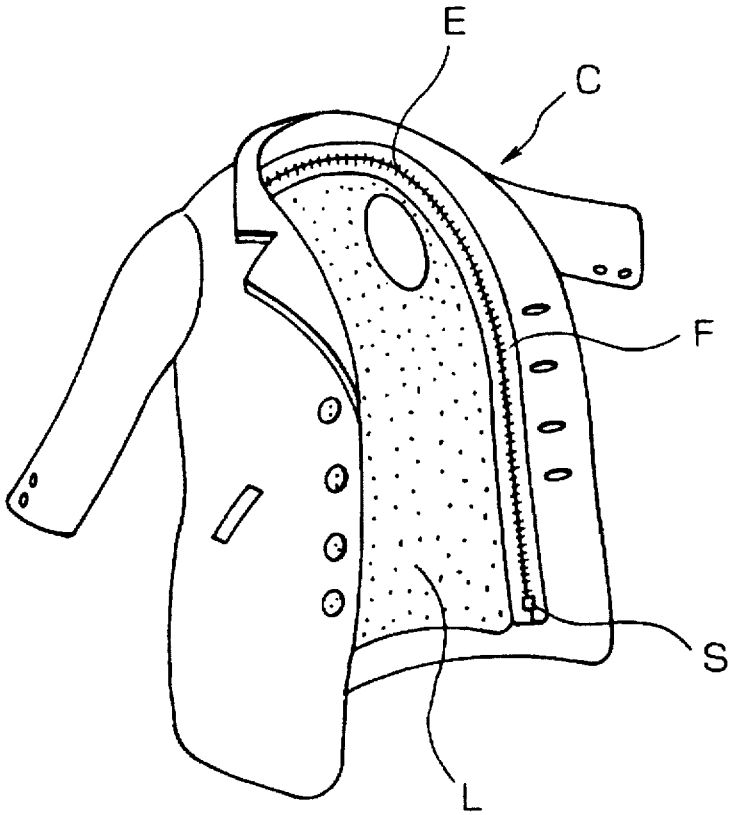
FIG. 10 is a perspective view showing a winter garment in which the warp-knit tape of this invention is used.

In use, assuming that opposite fastener stringers F are different in degree of stretch or in curvature, for instance, when the slide fastener is used in a cold-protection lining L to be detachably attached to a winter garment C, such as overcoat, ski wear or jumper, as shown in FIG. 10, the stretchable web portion 3, 13 of the warp-knit tape 1, 11 of one fastener stringer F is sewn to the marginal portion of the lining L while the web portion 3, 13 of the warp-knit tape 1, 11 of the other fastener stringer F is sewn to the back side of the winter garment C, whereupon opposed rows of fastener elements, E attached to the opposite fastener stringers F are coupled together by the slider S to attach the lining L to the garment C.

At that time, when the winter garment C assumes a curved posture at the sewing region of the fastener stringer F, the difference of curvature between the opposite fastener stringers F is absorbed by the stretchable web portion 3, 13, without affecting the coupling of the fastener elements E, thus guaranteeing smooth movement of the slider S.

The warp-knit slide fastener tape 1, 11 of this invention has the following advantageous results:

According to the warp-knit tape 1, 11, partly since the fastener-element-attaching portion 2, 12 has a stable warp-knit structure longitudinally non-stretchable and partly since the edge of the fastener-element-attaching portion 2, 12 is reinforced, it is possible to mount a row of fastener elements E on the tape 1, 11 in a stable posture so that reliable and smooth coupling of the fastener elements E can be guaranteed. Further, since it has an strethcable knit structure, the web portion 3, 13 adapts itself to stretching of a garment so as to be quickly sewn. Additionally, since the edge of the web portion 3, 13 is reinforced by two kinds of thick knitting yarns interlaced with one another so as to cause no damage of the knitting yarns, it is possible to sew the tape 1, 11 to the garment reliably and neatly as restricted in warp-wise stretching to some extent.

Further, since the fastener-element-attaching portion 2, 12 is knitted of chiefly chain-stitch knitting yarns 6, 15, it is possible to reliably restrict warp-wise stretching of the warp-knit tape 1, 11 so that mounting of fastener elements E on the tape 1, 11 can be facilitated. Furthermore, since textured yarns and multifilament yarns are interlaced with one another in the web portion 3, 13, it is possible to give the tape 1, 11 a pleasant touch or appearance and to finish the tape 1,11 improved in stretch.

Still further, since the outer wale of the web portion 3, 13 is formed of loops of thick single-cord-stitch knitting yarns and loops of thick tricot-stitch knitting yarns interlaced with the single-cord-stitch knitting yarns, it is possible to finish the tape edge in a reinforced and uniform posture, guaranteeing a neat warp-knit tape 1, 11.

Furthermore, partly since the outer edge of the web portion 3 is formed of two kinds of knitting yarns, i.e. a single thick single-cord-stitch knitting yarn 5 and two thick tricot-stitch knitting yarns 4, it is possible to restrict the streching of the tape edge and to reinforce the edge.

Still further, partly since single-cord-stitch knitting yarns 5 and tricot-stitch-knitting yarns 4 are arranged through the entire width of the tape 1 and partly since the fastener-element-attaching portion 2 additionally includes chain-stitch knitting yarns 6 and warp in-laid yarns, it is possible to reinforce the fastener-element-attaching portion 2 and to exactly restrict warp-wise stretching, thus finishing the tape 1 in a solid knit structure. On the other hand, the web portion 3 is formed of interconnected loops and hence are easily stretchable.

In addition, since the outer edge of the web portion 13 is formed of loops of two kinds of knitting yarns, i.e. one thick single-cord-stitch knitting yarn 17 and one thick two-needle-stitch knitting yarn 14, it is possible to restrict the tape edge from stretching to some extent and to reinforce the tape edge.

Further, partly since the warp-knit tape 11 has through its entire width two-needle-stitch knitting yarns 14 and partly since the fastener-element-attaching portion 12 additionally includes chain-stitch knitting yarns 15 and weft in-laid yarns 16, it is possible to finish tile tape 11 in a thick and solid knit structure which is restricted in warp-wise stretching. And since the web portion 13 additionally includes single-cord-stitch knitting yarns 17, it is possible to finish the tape 11 in a thick and stretchable knit structure.

What is claimed is:

1. A warp-knit tape for a slide fastener, having two outer edges and a plurality of parallel longitudinal wales, comprising:

(a) a web portion having a longitudinally stretchable first knit structure formed from knitting yarns of predetermined thicknesses, one outer edge of said first knit structure being knitted of two kinds of knitting yarns of greater thicknesses than the yarns of the web portion interlooped with one another;

(b) and a fastener-element-attaching portion having a longitudinally non-stretchable second knit structure formed from knitting yarns of predetermined thicknesses, an outer wale of said second knit structure opposite said outer edge of said first knit structure being knitted of knitting yarn thicker than the yarns of the fastener-element-attaching portion.

2. A warp-knit tape according to claim 1, wherein the wales of said fastener-element-attaching portion are knitted of chain-stitch knitting yarns and other knitting yarns interlooped with said chain-stitch knitting yarns, one of said chain-stitch knitting yarns which extends in and along the outer wale of said second knit structure being thicker than the yarns of the fastener-element-attaching portion, and wherein the wales of said web portion are knitted of single-cord-stitch knitting yarns formed of textured yarns, and other knitting yarns formed of muiltifilament yarns interlaced with said single-cord-stitch knitting yarns, one of said single-cord stitch knitting yarns and said other knitting yarns, which extend in and along the outer edge of said first knit structure, being thicker than the yarns of the web portion.

3. A warp-knit tape according to claim 1, wherein an outer wale of said web portion is knitted of loops of single-cord-stitch knitting yarns, each of which is thicker than the yarns of the web portion, and loops of tricot-stitch knitting yarns, each of which is thicker than the yarns of the web portion, being interlooped with those of said single-cord-stitch knitting yarns.

4. A warp-knit tape according to claim 2, wherein an outer wale of said web portion is knitted of loops of said single-cord-stitch knitting yarns, each of which is thicker than the yarns of the web portion, and loops of tricot-stitch knitting yarns, each of which is thicker than the yarns of the web portion, being interlooped with those of said single-cord-stitch knitting yarns.

5. A warp-knit tape according to claim 1, wherein the outer edge of said web portion is knitted of a single-cord-stitch knitting yarn which is formed of a single knitting yarn thicker than the yarns of the web portion, and tricot-stitch knitting yarn which are formed of two knitting yarns thicker than the yarns of the web portion, being interlooped with said single-cord-stitch knitting yarn.

6. A warp-knit tape according to claim 2, wherein the outer edge of said web portion is knitted of a single-cord-stitch knitting yarn which is formed of a single knitting yarn thicker than yarns of the web portion, and tricot-stitch knitting yarn which are formed of two knitting yarns thicker than the yarns of the web portion, being interlooped with said single-cord-stitch knitting yarn.

7. A warp-knit tape according to claim 3, wherein the outer edge of said web portion is knitted of a single-cord-stitch knitting yarn which is formed of a single knitting yarn thicker than the yarns of the web portion, and tricot-stitch knitting yarn which are formed of two knitting yarns thicker than the yarns of the web portion, being interlooped with said single-cord-stitch knitting yarn.

8. A warp-knit tape according to claim 4, wherein the outer edge of said web portion is knitted of a single-cord-stitch knitting yarn which is formed of a single knitting yarn thicker than the yarns of the web portion, and tricot-stitch knitting yarn which are formed of two knitting yarns thicker than the yarns of the web portion, being interlooped with said single-cord-stitch knitting yarn.

9. A warp-knit tape according to claim 1, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

10. A warp-knit tape according to claim 2, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

11. A warp-knit tape according to claim 3, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

12. A warp-knit tape according to claim 4, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

13. A warp-knit tape according to claim 5, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

14. A warp-knit tape according to claim 6, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

15. A warp-knit tape according to claim 7, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

16. A warp-knit tape according to claim 8, wherein every wale in said fastener-element-attaching portion and said web portion includes a single-cord-stitch knitting yarn and a tricot-stitch knitting yarn, every wale in said fastener-element-attaching portion additionally including a chain-stitch knitting yarn and a warp in-laid yarn.

17. A warp-knit tape according to claim 1, wherein the outer edge of said first knit structure in said web portion is knitted of a single-cord-stitch knitting yarn which is formed of a single knitting yarn thicker than the yarns of the web portion, and a two-needle-stitch knitting yarn which is formed of a knitting yarn thicker than the yarns of the web portion being interlooped with said single-cord-stitch knitting yarn.

18. A warp-knit tape according to claim 2, wherein the outer edge of said first knit structure in said web portion is knitted of a single-cord-stitch knitting yarn which is formed of a single knitting yarn thicker than the yarns of the web portion, and a two-needle stitch knitting yarn which is formed of a knitting yarn thicker than the yarns of the web portion being interlooped with said single-cord-stitch knitting yarn.

19. A warp-knit tape according to claim 1, every wale in said fastener-element-attaching portion and said web portion includes a two-needle-stitch knitting yarn, and every wale in said fastener-element-attaching portion additionally includes a chain-stitch knitting yarn and a weft in-laid yarn, and every wale in said web portion additionally includes a single-cord-stitch knitting yarn.

20. A warp-knit tape according to claim 2, every wale in said fastener-element-attaching portion and said web portion includes a two-needle-stitch knitting yarn, and every wale in said fastener-element-attaching portion additionally includes a chain-stitch knitting yarn and a weft in-laid yarn, and every wale in said web portion additionally includes a single-cord-stitch knitting yarn.

21. A warp-knit tape according to claim 17, every wale in said fastener-element-attaching portion and said web portion includes a two-needle-stitch knitting yarn, and every wale in said fastener-element-attaching portion additionally includes a chain-stitch knitting yarn and a weft in-laid yarn, and every wale in said web portion additionally includes a single-cord-stitch knitting yarn.

22. A warp-knit tape according to claim 18, every wale in said fastener-element-attaching portion and said web portion includes a two-needle-stitch knitting yarn, and every wale in said fastener-element-attaching portion additionally includes a chain-stitch knitting yarn and a weft in-laid yarn, and every wale in said web portion additionally includes a single-cord-stitch knitting yarn.

* * * * *